United States Patent [19]

Henrich

[11] 4,398,677

[45] Aug. 16, 1983

[54] WINDING APPARATUS FOR STRAND TYPE MATERIALS

[76] Inventor: Werner Henrich, Henrich GmbH, Patentabteilung, Postfach 1240, 6348 Herborn, Hess, Fed. Rep. of Germany

[21] Appl. No.: 263,298

[22] Filed: May 13, 1981

Related U.S. Application Data

[63] Continuation-in-part of Ser. No. 39,562, May 16, 1979, abandoned.

[30] Foreign Application Priority Data

May 31, 1978 [DE] Fed. Rep. of Germany ..... 2823718

[51] Int. Cl.[3] ..... B65H 54/00; B65H 75/00

[52] U.S. Cl. ..... 242/25 R; 242/45; 242/47; 242/47.5; 242/47.01

[58] Field of Search ..... 242/25 R, 25 A, 18 R, 242/54 R, 47, 82, 83, 47.5, 47.01, 47.12, 45; 226/118, 119

[56] References Cited

U.S. PATENT DOCUMENTS

| | | | |
|---|---|---|---|
| 2,186,106 | 1/1940 | Hargreaves et al. | 242/25 R |
| 3,038,674 | 6/1962 | Wahl | 242/25 R |
| 3,099,412 | 7/1963 | Nystrom | 242/47.01 |
| 3,394,896 | 7/1968 | Reichelt | 242/25 R |
| 3,413,834 | 12/1968 | Kovaleski | 242/25 R X |
| 3,570,776 | 3/1971 | Godderidge | 242/25 R |
| 3,891,155 | 6/1975 | Naegeli | 242/47.01 X |
| 4,050,641 | 9/1977 | Henrich | 242/25 R X |
| 4,058,265 | 11/1977 | Hedlund et al. | 226/118 X |
| 4,083,506 | 4/1978 | Mander et al. | 242/25 R |
| 4,186,861 | 2/1980 | Steinhilber | 226/118 |

FOREIGN PATENT DOCUMENTS

| | | | |
|---|---|---|---|
| 538927 | 4/1957 | Canada | 242/47.5 |
| 46-6095 | 2/1971 | Japan | 242/47.01 |
| 890952 | 3/1962 | United Kingdom | 242/25 R |

*Primary Examiner*—Stanley N. Gilreath
*Attorney, Agent, or Firm*—W. G. Fasse; D. H. Kane, Jr.

[57] ABSTRACT

The present winding apparatus for strand type materials such as wire, rope, strings or the like, facilitates the exchange of the reel or drum in the winding machine including a flyer so that a continuous operation, for example of a wire drawing machine, does no need to be interrupted. This continuous wire take-up is accomplished by a wire storing magazine and a so-called dancer arranged between the wire drawing machine and the winding apparatus. The magazine has a variable capacity for storing a quantity of the elongated material during the time when the reel or drum in the winding machine is exchanged. The so-called dancer is arranged between the variable capacity magazine and the winding machine for controlling the winding speed of the flyer. The magazine may comprise a plurality of block and tackle rollers arranged in sets one of which is movable to vary the storage capacity. The dancer also has a movable pulley for controlling the speed of the drive motor of the flyer.

4 Claims, 12 Drawing Figures

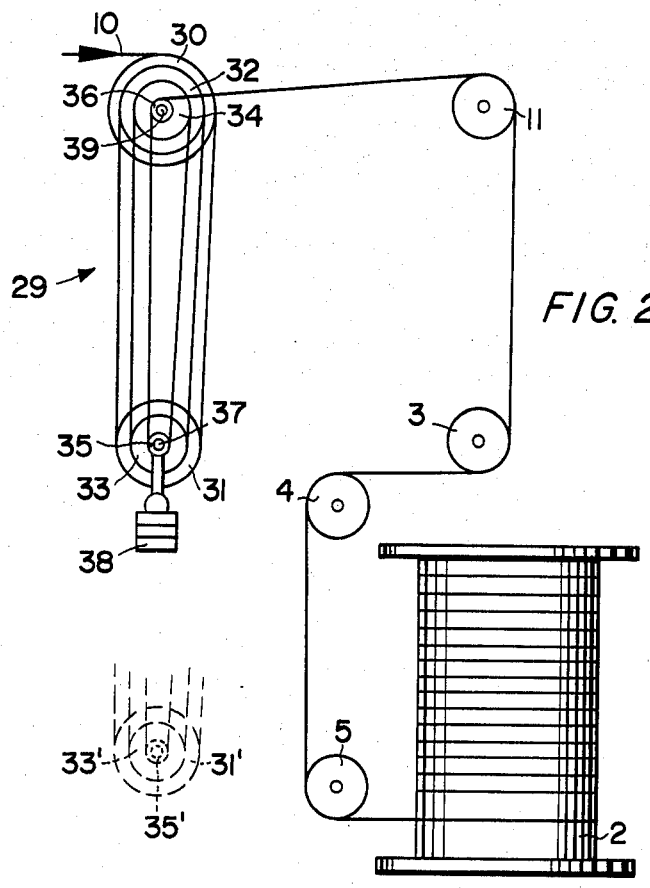
FIG. 2
FIG. 7
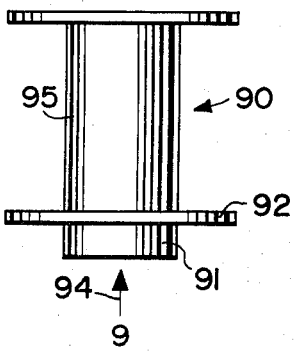
FIG. 8
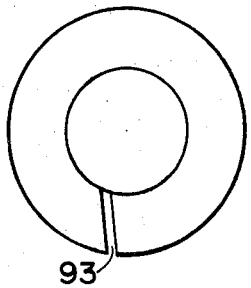

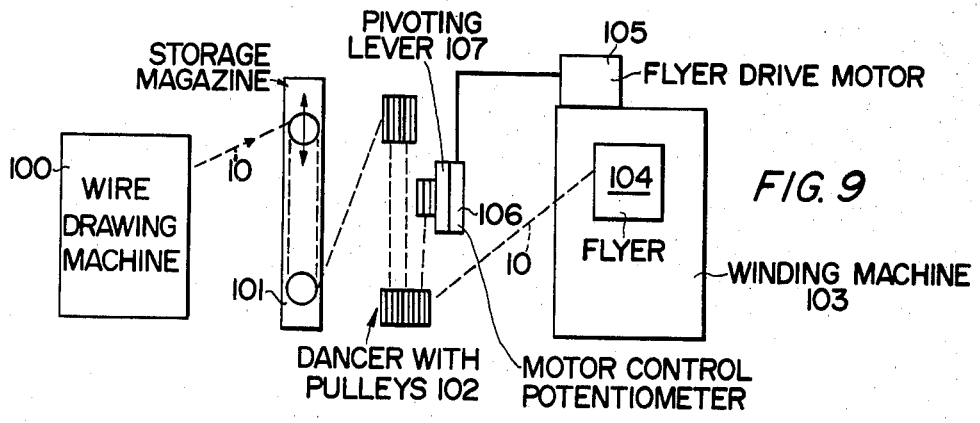
FIG. 9
FIG. 10
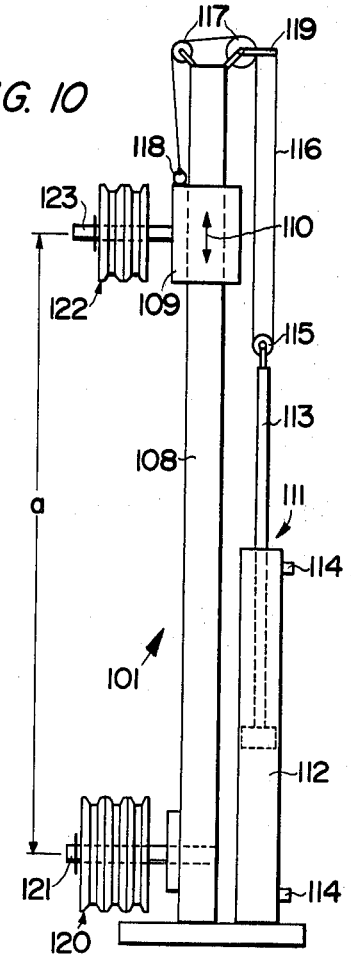
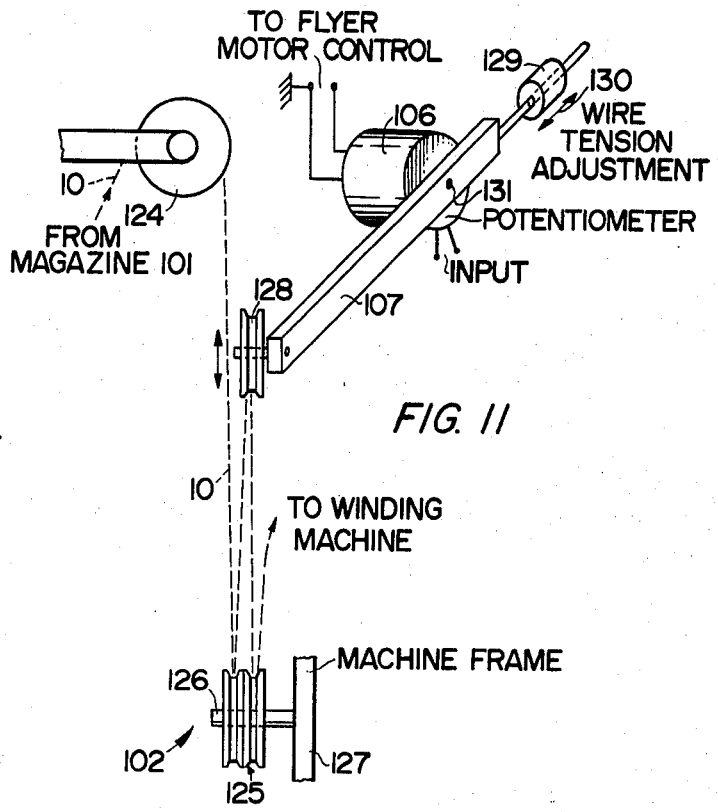
FIG. 11

WINDING APPARATUS FOR STRAND TYPE MATERIALS

CROSS-REFERENCE TO RELATED APPLICATIONS

The present invention is a continuation-in-part application of my copending application Ser. No. 039,562, filed in the U.S. Patent and Trademark Office on May 16, 1979, now abandoned. The priority of German Ser. No: P 2,823,718.5, filed in the Federal Republic of Germany on May 31, 1978 is hereby claimed through the parent case U.S. Ser. No: 039,562.

BACKGROUND OF THE INVENTION

The invention relates to a winding apparatus for elongated, strand type material such as wires, ropes, strings, or the like, in which the elongated material is wound up on a bobbin, reel, or drum by means of a flyer. In the following text the elongated material may simply be referred to as "wire", however, it is to be understood that the invention is not limited to the winding of wire onto a bobbin, reel, or drum, forming winding carrier means.

Such winding apparatus is used, for example, in combination with a wire drawing machine. If the bobbin, reel, or drum has been filled up, it is necessary to exchange it for an empty one. It is, however, undesirable to interrupt the continuous operation of the wire drawing machine for the purpose of exchanging the bobbin, reel, or drum in the winding apparatus. Thus, it is known in connection with winding devices operating with a rotatable drum to transfer the wire during the operation of the machine, from the filled up reel onto a prepared empty reel. However, this type of operation is not possible in a machine comprising a so-called "flyer" also known as a speed frame, because the flyer which revolves around the reel interferes with the transferring of the wire from the filled to the empty reel.

U.S. Pat. No. 4,058,265 (Hedlund et al) discloses a magazine for storing elongated material by means of two sets of pulleys forming a block and tackle arrangement. One set of pulleys is stationary. The other set of the pulleys is movable up and down along a support column. For this purpose a motor and gear moves the movable pulley set up or down through a cable pull. The control of the cable pull motor is not disclosed by Hedlund et al.

Canadian Patent No. 538,927 (Hollingsworth et al) discloses a cable magazine similar to that disclosed by Hedlund et al. Hollingsworth et al also employ sets of pulleys. Additionally, the Canadian Patent discloses a wire tension sensing roller 23 on a bellcrank 24 which controls either mechanically through a linkage system or electrically through a variable resistor the drive means for the so-called haul-off wheel 14 to maintain a desired wire tension in the pulley system. This type of prior art control as shown in said Canadian Patent No. 538,927 responds to the wire tension directly downstream, as viewed in the wire feed advance direction, of the so-called haul-off wheel 14 and provides a "backward" control of the haul-off wheel.

It is also known from British Patent No. 890,952 to use a block and tackle system for storing elongated material in which one set of pulleys is apparently movable down under its own weight and up under the tension of the material being wound onto a drum. No controls are disclosed in this British Patent No. 890,952.

My own U.S. Pat. No. 4,050,641 discloses a wire winding apparatus in which the wire is wound onto a drum by means of a so-called flyer which may be arranged to have a horizontal or a vertical axis of rotation. In my previous patent the wire tension is controlled in two ways. A weight counterbalancing a tension sensing roller provides one control. The counterbalancing weight is secured to one end of a lever and the sensing roller is secured to the other end of the lever which is journalled intermediate its ends. The lever also operates a rheostat for adjusting the speed of the flyer drive motor, whereby a second wire tensioning control is provided. This type of winding machine does not provide any storage means acting as a buffer between the wire drawing machine and the wire winding machine.

U.S. Pat. No. 3,891,155 (Naegeli) discloses a winding system in which the storage facility is itself a winding drum with a flyer and storage drum arranged upstream of the actual winding drum. This operation requires winding the wire twice which in turn calls for two winding mechanisms with the respective drive means. The wire tensioning is accomplished by varying the speed of the winding motor. In another embodiment Naegeli uses a so-called "dancer" arrangement as a storage with a limited capacity.

Naegeli does not teach how the storage capacity could be increased while simultaneously avoiding the use of a full winding drum with its own flyer as a storage facility.

OBJECTS OF THE INVENTION

In view of the foregoing it is the aim of the invention to achieve the following objects singly or in combination:

to equip or modify a winding machine operating with a so-called flyer so that the reel exchange may be accomplished without interrupting the continuous operation of a preceding machine such as a wire drawing machine or the like;

to operatively interpose between a production machine and a take-up or winding machine a storage facility which is capable of taking up the continuously produced elongated material while the winding thereof is temporarily interrupted;

to interpose between a production machine and a take-up machine a storing facility capable of a variable storing capacity and preferably also a variable storing speed;

to control the output feed advance speed of the elongated material exiting from the storage facility in accordance with the instantaneous operating requirements of the winding machine;

to maintain the feed advance speed of the wire substantially constant at the point where a winding or take-up reel is to be exchanged so that the wire transfer may take place without any jolt; and to coordiate means for transporting empty and/or filled reels or drums, with the winding machine proper.

SUMMARY OF THE INVENTION

According to the invention there is provided an apparatus for winding elongated materials such as wire onto bobbins, reels, or drums which cooperate with an auxiliary means operatively interposed between a manufacturing machine and the winding machine whereby the auxiliary means operate as a storage or magazine and as a feed advance or speed control of the wire downstream of the magazine and upstream of the winding machine. A quantity of wire is always present in the magazine and the flyer of the winding machine is stopped for exchanging the drum. The wire is severed and the end is then secured to a new empty drum. During the time taken up by these operational steps the magazine keeps taking up wire. Once the flyer is started again the winding apparatus takes out wire from the magazine. However, a certain length of wire preferably remains in the magazine at all times.

Keeping a certain length of wire in the magazine in combination with placing the dancer between the magazine and the winding machine has the advantage that a very sensitive control of the flyer speed is achieved in response to the position of the movable dancer member, whereby the flyer speed is decreased when the wire tension increases. On the other hand, the flyer speed is increased when wire tension decreases. Thus, the dancer constitutes a very sensitive buffer which equalizes the nonuniform wire withdrawal. The storage speed of the wire in the magazine is suitably so selected that it corresponds substantially to the winding speed of the wire when the bobbin, reel, or drum is partially filled.

The magazine comprises a block and tackle arrangement in which one set of blocks or pulleys is movable by a piston cylinder arrangement. The dancer has at least one movable pulley set which may be counterbalanced or which may cooperate with the adjustable pulley set of the magazine.

BRIEF FIGURE DESCRIPTION

In order that the invention may be clearly understood, it will now be described, by way of example, with reference to the accompanying drawings, wherein:

FIG. 2 illustrates in a schematic manner an embodiment wherein the magazine comprises a block and tackle arrangement;

FIGS. 7 and 8 show a preferred drum structure, whereby FIG. 7 is an elevational view of the drum and FIG. 8 is a view in the direction of the arrow in FIG. 7;

FIG. 9 shows in block form the improvement with a wire magazine and a dancer between the wire drawing machine and the winding machine;

FIG. 10 is a side view of a block and tackle type wire magazine according to the invention;

FIG. 11 shows a perspective view of a dancer cooperating with its movable pulley means with a lever arm for adjusting a potentiometer.

DETAILED DESCRIPTION OF PREFERRED EXAMPLE EMBODIMENTS AND OF THE BEST MODE OF THE PRESENT INVENTION

Figure 1:
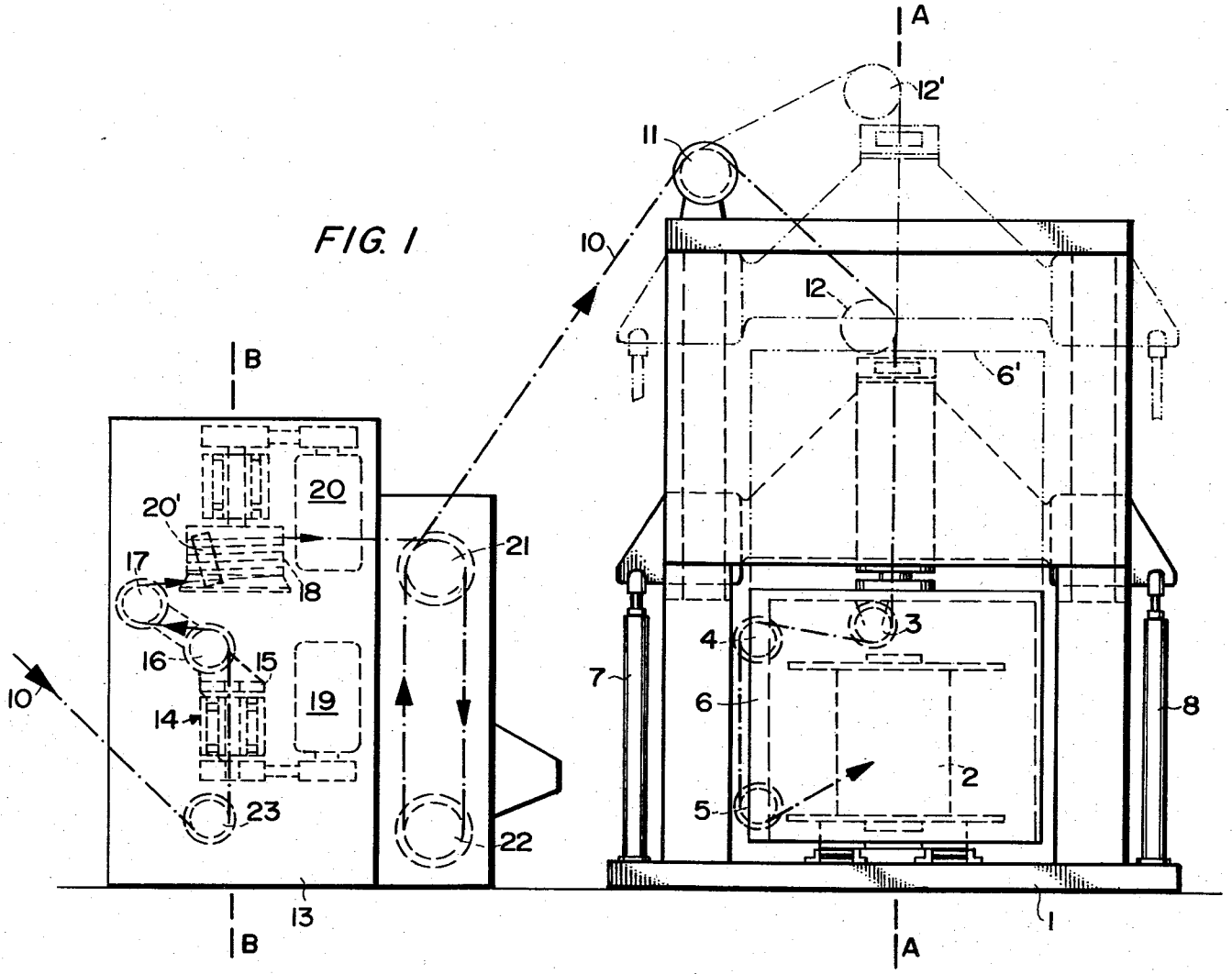
FIG. 1 illustrates a schematic elevational side view of an apparatus which may be improved according to the invention, including a winding machine and a magazine arranged upstream of the winding machine as viewed in the feed advance direction of the wire.

FIG. 1 illustrates a side elevational view of a winding apparatus 1 comprising a substantially stationary drum 2 onto which the wire 10 is to be wound. A frame 6 is rotatable about the longitudinal axis "A-A". The frame 6 may have a closed end thus forming a pot shape and carries rollers 3, 4, and 5 with the aid of which the wire 10 is wound onto the core of the drum 2. The rollers 3, 4, and 5 and the rotatable frame 6 constitute the so-called flyer or speed frame.

The idler rollers 11 and 12 guide the wire 10 to the flyer roller 3 in the rotational axis A-A of the flyer. The frame 6 of the flyer is movable vertically up and down, for example, by means of hydraulic piston cylinder means 7 and 8 which may lift the flyer, for example, in the position indicated in dashed lines in FIG. 1 at 6', whereby the roller 12 would be located in the dashed line position 12'. The individual wire windings are placed on the core of the drum 2 due to the back and forth movements of the rotating flyer as is conventional.

The wire 10 is produced in a wire drawing machine 100 schematically shown in FIG. 10. The wire drawing machine 100 is not part of this invention. The wire 10 moves with a constant speed initially into a magazine 13 where it is guided by a roller 23 into the rotational axis "B-B" of a further flyer 14. The flyer 14 comprises a carrier member 15 supporting two rollers 16 and 17 of which the roller 17 applies the wire 10 to the lower end of a drum 18. The flyer 14 is driven by a motor 19. The lower end of the drum 18 is slightly conical as shown in FIG. 1, whereby the wire turns are shifted upwardly. An elongated cylindrical roller 20' presses against the windings thereby facilitating the shifting of the windings upwardly. The drum 18 is also rotatable about the rotational axis "B-B". The drum 18 may be freely rotatable or it may be driven by a motor 20, the operational speed of which is then suitably controlled in response to the take-up speed of the wire 10. As the wire is being wound onto the drum 2 enough wire is taken off the drum 18 by the winding apparatus 1 for the winding operation. The wire drawn off the drum 18 runs over the rollers 21 and 22 to the roller 11 of the winding apparatus 1.

In operation, the wire drawing machine 100 supplies the wire continuously at a constant speed into the magazine 13. If wire is not being withdrawn from the magazine 13, for example, because the drum 2 of the winding apparatus 1 is being exchanged for an empty drum, then more and more wire is being accumulated on the drum 18. As soon as the exchange is completed and the wire end secured to the empty drum the winding operation in the apparatus 1 begins and wire is being drawn off the drum 18. Due to the initially small diameter of the wire windings on the drum 2 the take-up speed of the wire is initially respectively small so that less wire is being taken off the drum 18 than is accumulated on the drum. As the diameter of the windings on the drum 2 increases, the take-up speed of the wire 10 also increases during the winding operation whereby an equilibrium is established at a certain point during the winding operation so that as much wire is being drawn off the drum 18 as is being accumulated simultaneously on the drum 18. However, as the diameter of the windings on the drum 2 keeps increasing beyond this point of equilibrium, the take-up speed of the wire 10 also increases whereby more wire is being taken off the drum 18 in the magazine 13 than is supplied to the drum 18. During this last mentioned phase of the winding operation the number of windings on the drum 18 is reduced. However, the arrangement is such that some wire remains on the drum 18 in the magazine 13 at the time when the drum 2 is completely filled.

FIG. 2 illustrates a modification in which the magazine 29 comprises a block and tackle arrangement with pulleys or rather blocks 30, 31, 32, 33, 34, 35, and 36. The blocks 31, 33, and 35 form a set and are rotatable about a journal pin 37 to which there is secured a weight 38 for keeping tight the wire accumulated in the magazine. The blocks 32, 34, and 36 form a further set and are rotatable about a journal pin 39 which is supported in the frame structure of the magazine. Such frame structure is not shown for simplicity's sake.

If the winding speed of the wire onto the drum 2 is smaller than the run-in speed of the wire 10 into the block and tackle arrangement of the magazine 29, or if the drum 2 is just being exchanged so that no wire at all is being drawn out of the magazine, then the rollers 32, 33, 35 will be lowered, for example, into the dashed line position at 31', 33', and 35' whereby more wire is accumulated in the magazine 29. However, if the take-up speed of the drum 2 exceeds the run-in speed of the wire into the magazine 29, the rollers 31, 33, and 35 are being lifted to such an extent that they reach their uppermost position when the drum 2 is full. Thus, the relative distance between the journal pins 37 and 39 varies the storing capacity of the magazine 29.

Figure 3:
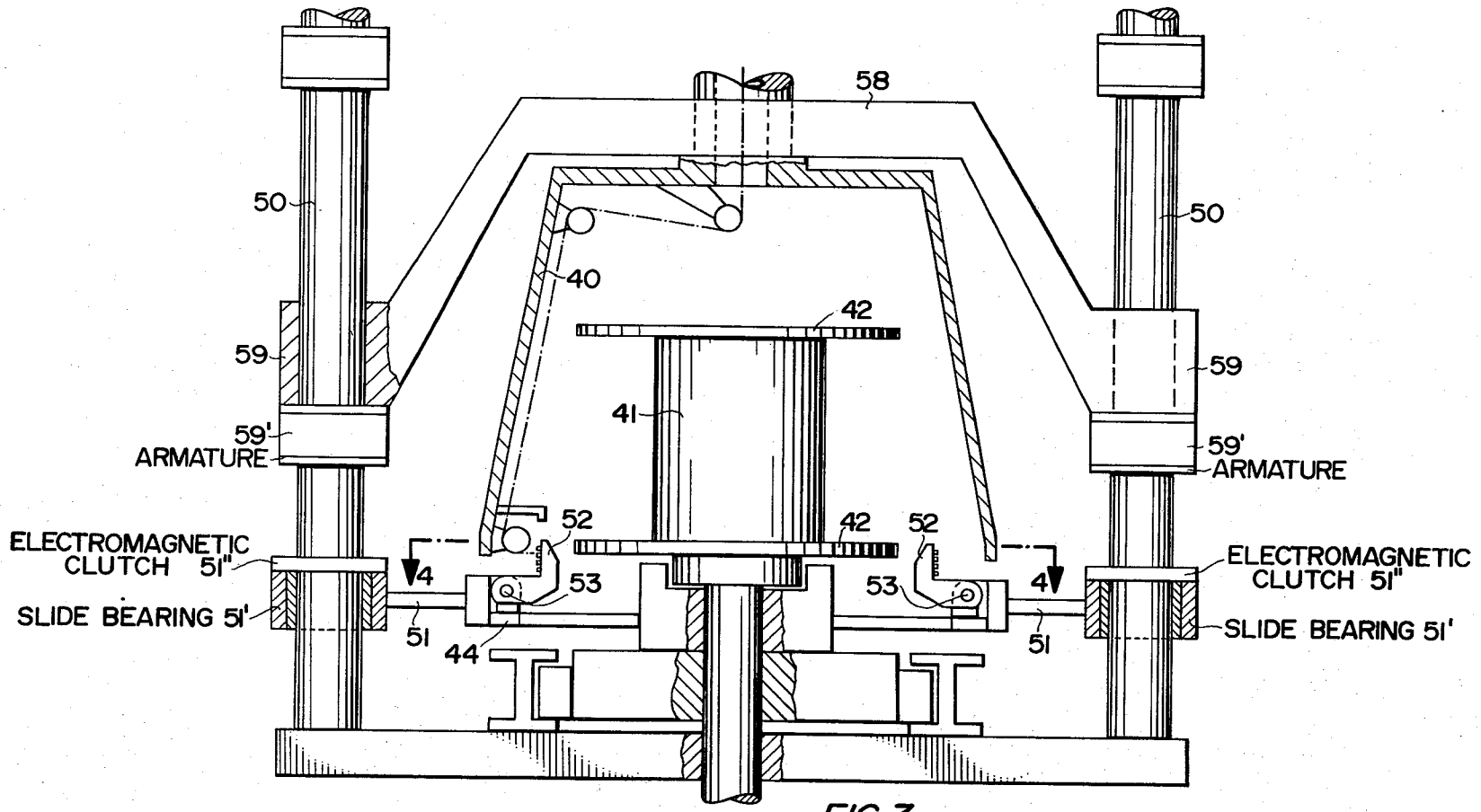
FIG. 3 shows a front view partially in section of an example embodiment of the flyer lifting means.
Figure 4:
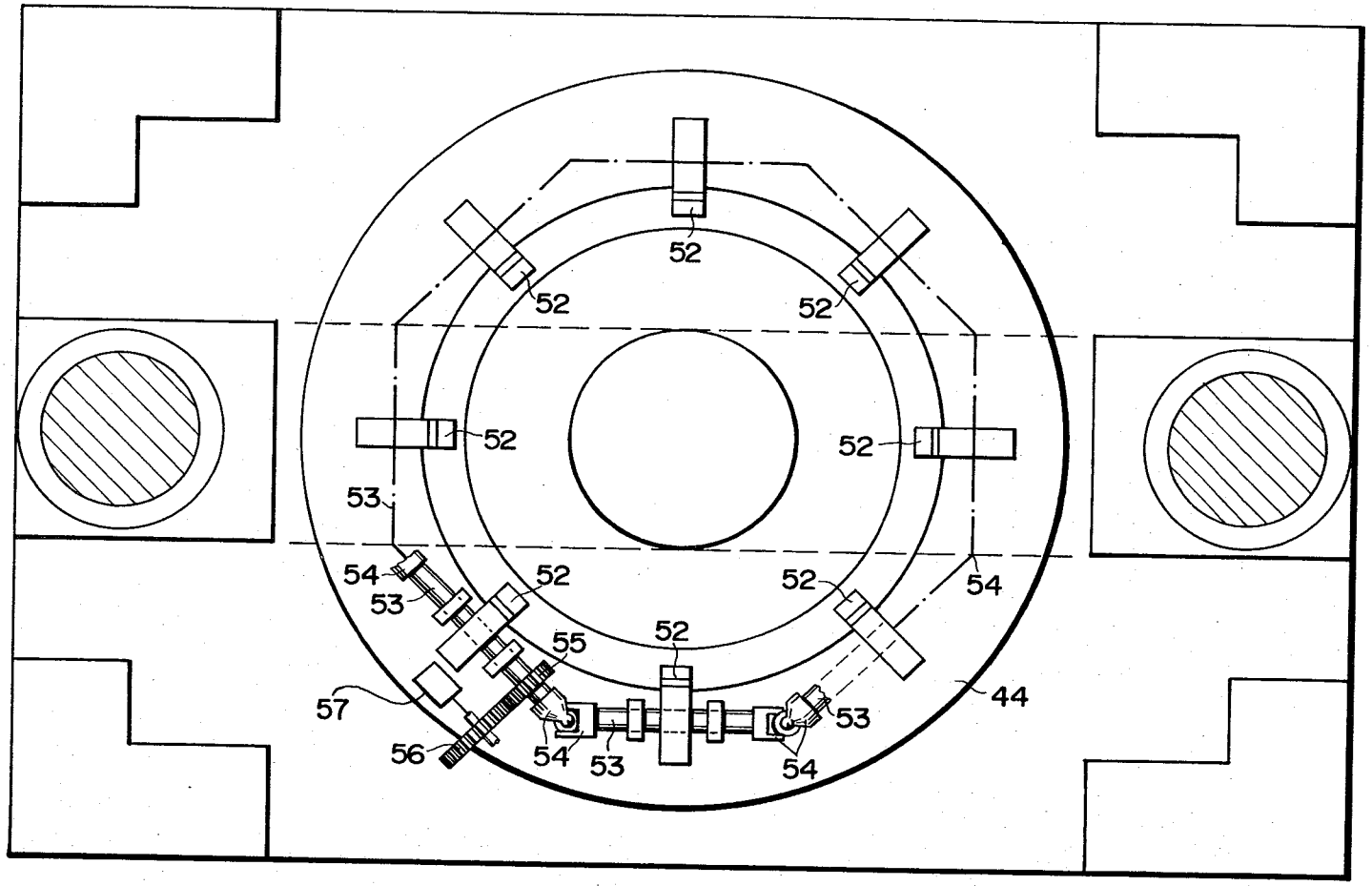
FIG. 4 illustrates a sectional view along the section plane 4—4 in FIG. 3.

FIG. 3 illustrates an embodiment for a flyer lifting device with a flip-over device comprising a plurality of flip-over elements 52 driven as shown in FIG. 4. The embodiment of FIG. 3 does not comprise a scrap disk. The wire is flipped directly onto the core of the full drum in this embodiment. The flyer 40 is moved up and down along guides 50 between upper and lower positions by conventional lifting means as, for example, disclosed in my earlier U.S. Pat. No. 4,050,641 with reference to FIG. 3 thereof.

The ring 44 is connected to slide bearings 51' by arms 51. The slide bearings 51' are movable up and down along the guide posts 50. A carrier frame 58 for the flyer 40 also slides along the guide posts 50 by means of guide bushings 59 equipped with respective clutch armatures 59' arranged for cooperation with electromagnetic clutches 51' secured to and movable with the slide bearings 51'. Thus, when the armatures 59' contact the electromagnetic clutches 51'' the latter may be energized electrically so as to move the ring 44 up or down together with the flyer carrier frame 58, whereby the movement of the ring 44 may be synchronized with the flyer up and down movement. Hence, the ring 44 is also moved into its upper position for the drum exchange. The ring 44 has secured thereto flip-over elements 52 which are rotatable about respective shafts 53, please see FIG. 4. The shafts 53 are interconnected in a rotational manner by means of a universal joint 54 so that all shafts 53 are rotated if one shaft 53 is being rotated for tilting the flip-over elements 52. The shafts 53 are driven by means of a gear wheel 55 meshing with a further gear wheel 56 which is conventionally driven by a motor 57 for flipping over the wire.

Figure 5:
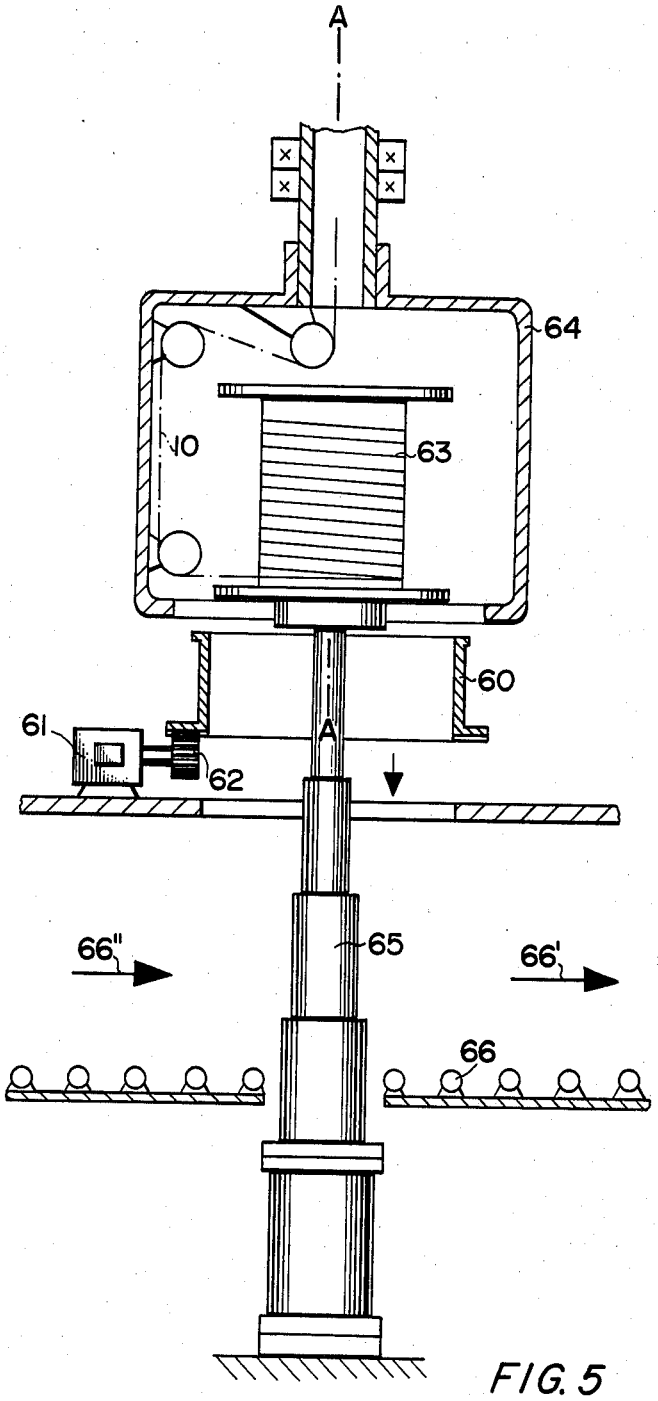
FIG. 5 illustrates an elevational, partially sectioned view of an embodiment with hydraulic means for facilitating the exchange of a filled drum by an empty drum and further showing transport means for the drum.

FIG. 5 illustrates a scrap disk in the form of a ring 60 driven by a motor 61 through a gear train 62 or any other suitable driving mechanism capable of rotating the scrap disk 60 about the rotational axis "A-A". The purpose of the so-called scrap disk or ring is to take up a certain length of wire which is then manually discarded as scrap but on the disk or ring it serves as a speed control or buffer as will be described below. The ring 60 is rotatable independently of the flyer 64 by a motor 61 and gear drive 62. The inner diameter of the ring 60 is larger than the diameter of the drum flange of the drum 63 so that the drum 63 may be moved downwardly, for example with the aid of hydraulic means 65, through the ring 60. The hydraulic means 65 deposits the drum of a transport roller conveyor 66 which moves the filled drum away in the direction of the arrow 66' whereas an empty drum may be supplied also by the conveyor 66 in the direction of the arrow 66''. The operation of the drum insertion and withdrawal may be accomplished manually or by a drive mechanism that may be coupled to the transport conveyor 66.

The flyer 64 winds the wire 10 onto the drum 63. If the drum 63 is filled the wire is passed over onto the scrap ring 60. Since the ring 60 has a larger diameter than the winding diameter of the wire on the drum 63, the ring 60 is started to rotate prior to the wire transfer at a speed such that the flyer 64 may wind the wire onto the ring 60 with the same speed as it was wound onto the drum 63 when the latter was about filled. The ring 60 is driven in the direction of the flyer rotation with the required speed by said motor 61 and gear 62. If the emptry drum is moved into the winding position again a speed adaptation takes place in that the rotational speed of the ring 60 is varied. If necessary the rotational speed of the flyer is reduced since the diameter of the ring is substantially larger than the diameter of the core of the empty drum. Thus, without the just described speed adjustment the wire would be subjected to a substantial jolt which is avoided as just described. Therefore, this embodiment makes it particularly possible to continuously wind very thin wires onto successive coils without any interruptions.

After the wire has been transferred onto the core of the empty drum, the speed of the flyer may be increased. As mentioned, the wire reserve on the scrap disk or ring 60 may be discarded manually as scrap.

Figure 6:
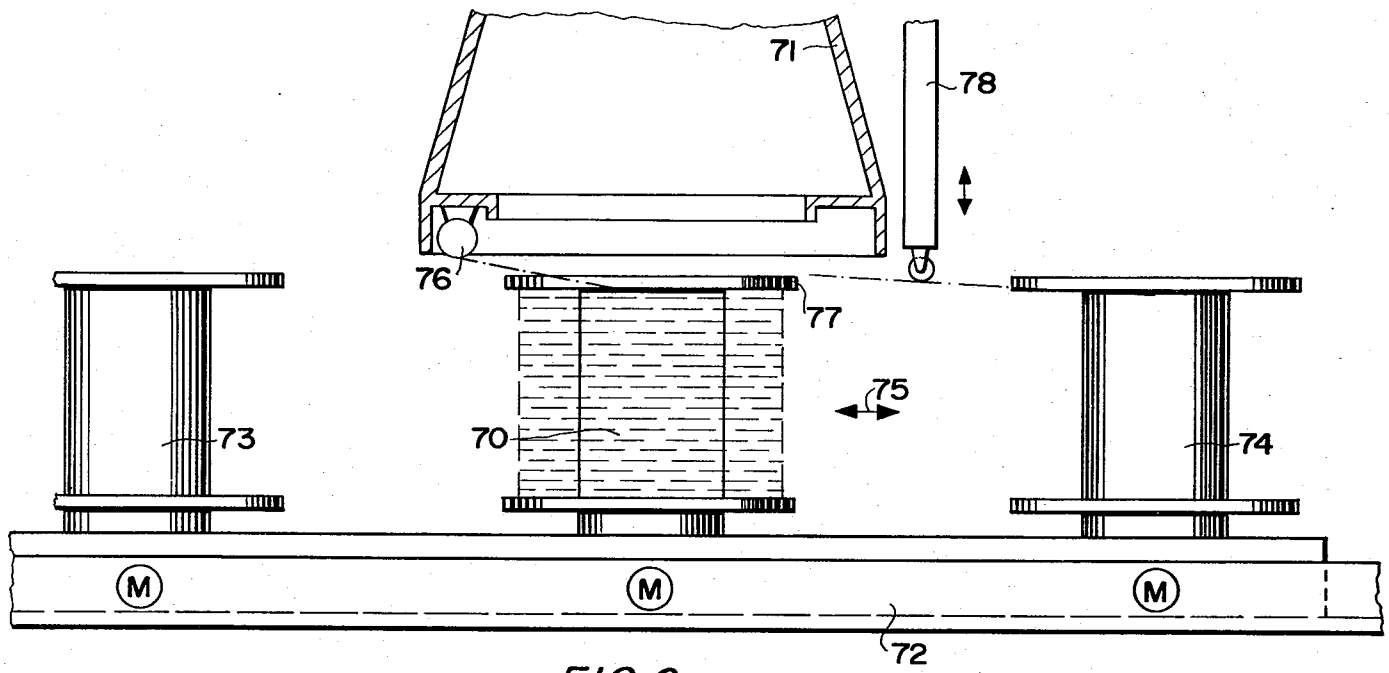
FIG. 6 shows a side view partially in section of an embodiment in which the drum is supported on a transport mechanism.

FIG. 6 illustrates an embodiment wherein the flyer 71 winds wire onto the drum 70 which is located on a transport mechanism 72 on which the drum 70 may be selectively rotated by means of a motor M. To the left of the drum 70 there is an empty drum 73 also rotatable by a respective motor M on the transport mechanism 72. To the right of the drum 70 also supported on the transport mechanism 72 is a further empty drum 74 also rotatable by a respective motor M. When the drum 70 is filled, the flyer 71 is lifted to such an extent that the drum 70 may be moved in the direction of the double arrow 75 by the transport mechanism 72. The flyer is stopped for exchanging the drum 70. The flyer remains stationary on the side of the spool which is opposite to the removal direction of the filled drum, in the example on the left side of the drum 70, if the latter is removed toward the right side of FIG. 6.

The drum 70 is rotated commensurate to the speed reduction of the flyer 71 so that the wire being supplied is wound onto the drum 70 uniformly. The winding operation is not even interrupted when the full drum 70 is moved to the right and out of the winding apparatus. In order to prevent the wire from being pulled too much over the upper flange, a hold down roller mechanism 78 is pressed downwardly to guide the wire in a suitable manner.

To the same extent to which the full drum 70 moves out from the central position under the flyer 71, the empty drum 73 moves into the winding apparatus. The flyer 71 moves downwardly with the guide roller mechanism 78 whereby the flyer does not yet perform any rotary movement. After the flyer 71 has reached the outer or upper flange 77 of the empty drum, the wire may be severed manually and secured to the empty drum, for example in a drum slot 93 shown in FIG. 8. The full drum is removed and the wire end of the full drum is secured thereto, for example, by means of an adhesive tape or the like. When the wire end is secured to the empty drum the flyer 71 is started to rotate again. The wire application begins and the wire is being properly layed down between the flanges of the drum. The standstill of short duration of the apparatus as well as the diameter difference between the edge of the scrap disk and the core of the drum is compensated by means of the so-called dancer or dancing magazine originally mentioned in my parent case U.S. Ser. No. 039,562, and now more fully shown in FIGS. 9 to 12.

FIGS. 7 and 8 illustrate a drum 90 especially suitable for the present purposes. The drum 90 is provided with a scrap disk end 91 at the lower ends of the drum below the lower flange 92. Further, the lower flange 92 is provided with a slot 93 as best seen in FIG. 8 showing a view in the direction of the arrow 94 in FIG. 7. The slot 93 serves for securing the wire end to the flange 92 as mentioned above. As soon as the wire end is clamped down the flyer begins its rotation and wire laying along the core 95 of the drum 90.

After the wire has been placed through the slot 93 from the side of the scrap disk 91 the remaining sequence is the same as described above with reference to the preceding example embodiments.

When the drum 73 is filled an empty drum is supplied from the right side and the above described operation takes place in the opposite sequence.

Making the core of the drum at least partially conical as shown, for example, for the drum 18 in FIG. 1 and arranging a pressure roller 20' for cooperation with the drum as the wire is being wound onto the drum has the advantage that the individual wire windings are uniformly distributed laterally over the length of the drum and that it is prevented that turns of the same winding layer come to rest one on top of the other. Due to this feature of the invention it is possible that the wire may be wound onto the drum in one location and may be drawn off the drum in another location.

In the embodiment of FIG. 2 the advantage of a very flexible storage capacity of the block and tackle arrangement is achieved due to the movability of the rollers or blocks 31, 33, 35 in response to the weight 38 or in response to a positive drive, as will be described below, which may move the journal axis 37 of the just mentioned rollers up and down or horizontally back and forth so that the positive drive keeps the wire running around the blocks or rollers sufficiently tight. As mentioned, if no wire is withdrawn from the block and tackle system the lower blocks move downwardly thereby increasing the storage capacity due to the increased spacing of the lower rollers from the upper rollers, whereby more wire is accumulated in the storage facility. On the other hand, if more wire is withdrawn from the block and tackle system than is supplied thereto, the spacing between the lower and upper blocks is reduced and the storage capacity becomes correspondingly smaller. The mentioned drive for positively moving the journal 37 and the rollers thereon relative to the journal pin 39 may be a hydraulic, pneumatic or any other suitable type.

As mentioned, suitably the winding speed of the wire onto the drum in the winding apparatus is so selected, that, as the coil becomes fuller and fuller, said winding speed exceeds the speed of the wire running into the magazine when a certain filling condition or drum diameter has been reached, whereby more wire is being withdrawn from the magazine than is supplied into the magazine. Thus, when the drum is full, a small amount of surplus wire will remain in the magazine.

It is preferable to arrange the rotational axis of the drum in a vertical position. However, the present apparatus is also suitable for operation with a horizontal drum axis.

The axial displacement of the ring 44 is advantageously accomplished by using the rapid traverse movement of the flyer for the ring movement as described with reference to FIG. 3.

The advantage of the arrangement shown in FIG. 6 in which the full drum is moved laterally out of the winding apparatus while an empty drum is simultaneously moved into the winding apparatus is seen in that both, the full and the empty drum may be transported on a common transport mechanism 72 which would move alternately in one or the other direction as indicated by the arrow 75. The lowering and lifting of the flyer may be accomplished by conventional means. In this embodiment it is preferable that the drums are rotatable independently of each other by respective motors M. For exchanging the drums the flyer 71 is lifted and stopped. As the flyer stops the full drum begins rotating to take up the further supplied wire. The full coil keeps taking up wire even at the time when it is moving out of the winding apparatus until the wire is within the zone of the empty drum. At that point the wire is gripped by the guiding mechanism 78 so that the wire may be wound onto the empty drum or onto the scrap disk of the empty drum. The wire between the flyer and the full drum may be severed manually. Upon completion of the transfer of the wire onto the empty drum, the latter is slowed down and stopped. To the same extent the flyer 71 begins its rotation to take over the normal winding operation.

In order to transfer the wire from the ring to the full drum or to the scrap disk of the drum the ring 44 is equipped with a wire throw off mechanism comprising the above mentioned ring elements 52 and the drive means 53, 56, 57 connected to the ring elements 52. This throw-off mechanism may comprise a plurality of tiltable pins, studs, or the like which are tiltable as described.

The embodiment of FIG. 5 in which the so-called scrap disk 60 is provided with its own drive 61, 62 has the advantage that the scrap disk may be driven independently of the drum 63. Since the so-called scrap disk 60 is a ring with an inner diameter larger than the diameter of the flanges of the drum 63 the latter may freely move through the ring. Thus, the full coil may be moved, for example, by a hydraulic lifting mechanism through the ring 60 downwardly, onto a transport mechanism as described, for lateral removal. The further advantage of the use of a transport mechanism is seen in that it may simultaneously supply an empty drum to the winding apparatus, whereby the hydraulic lifting mechanism 65 can lift the empty drum into the operating position. During the exchange of the drums the flyer 64 is moved into a position in which it may wind the wire onto the scrap disk or ring 60 which thus operates as a temporary storage. The wire on the scrap disk 60 is manually discarded after a new drum has been started.

FIG. 9 illustrates the above mentioned dancer 102 arranged downstream of a storage magazine 101 which in turn is arranged downstream of a wire drawing machine 100 of conventional construction. The wire 10 moves from the wire drawing machine 100 into the block and tackle storage magazine 101 forming a first variable capacity storage magazine and from the latter into the dancer 102 forming a second storage magazine which in turn supplies the wire 10 into a winding machine 103 having a flyer 104 driven by a flyer drive motor 105, the speed of which is controlled by a motor control potentiometer 106 which is adjusted by a pivoting lever 107 shown in more detail in FIG. 11.

FIG. 10 shows the storage magazine 101 comprising an upright post 108 slidably supporting a carriage 109 which is movable up and down as indicated by the double arrow 110 by means of a hydraulic or pneumatic piston cylinder arrangement 111 comprising a cylinder 112 and a piston rod 113. The cylinder 112 has conventional ports 114 for the controlled admission of a pressure medium as is conventional. A pulley 115 is secured for rotation to the top of the piston rod 113 for raising and lowering the carriage 109 by means of a cable 116 running over further pulleys 117 and secured to the carriage 109, for example, by means of an eye or hook 118. The opposite end of the cable 116 is secured to an arm 119 extending from the top of the post 108.

A first set of blocks or pulleys 120 is rotatable on a stationary shaft 121 flanged to the post 108. A second set of pulleys 122 is rotatable on a shaft 123 rigidly secured to the carriage 109. Thus, by moving the carriage 109 up and down the spacing "a" between the shafts 121 and 123 may be varied, whereby the length of wire that may be stored in the storage magazine 101 may also be varied in accordance with the changing storage capacity depending on said spacing "a".

FIG. 11 shows the dancer 102 which also functions as a magazine as will be described in more detail below. The dancer 102 comprises a first set of stationary pulleys or guide rollers 124 which receive the wire 10 from the magazine 101 and supplies the wire to a second set of stationary pulleys 125 rotatably supported on a shaft 126 supported by the machine frame 127. The dancer 102 further comprises a movable set of pulleys 128 rotatably secured to one end of the pivoting lever 107, the other end of which carries an adjustable weight 129 which is movable in the direction of the double arrow 130 for adjusting the wire tension. The lever 107 is pivoted at 131 to the potentiometer 106 for adjusting the potentiometer 106 to thereby control the speed of the flyer motor 105. The operation of the apparatus will be described in more detail below. The weight 129 is adjusted to a normal wire tension.

Figure 12:
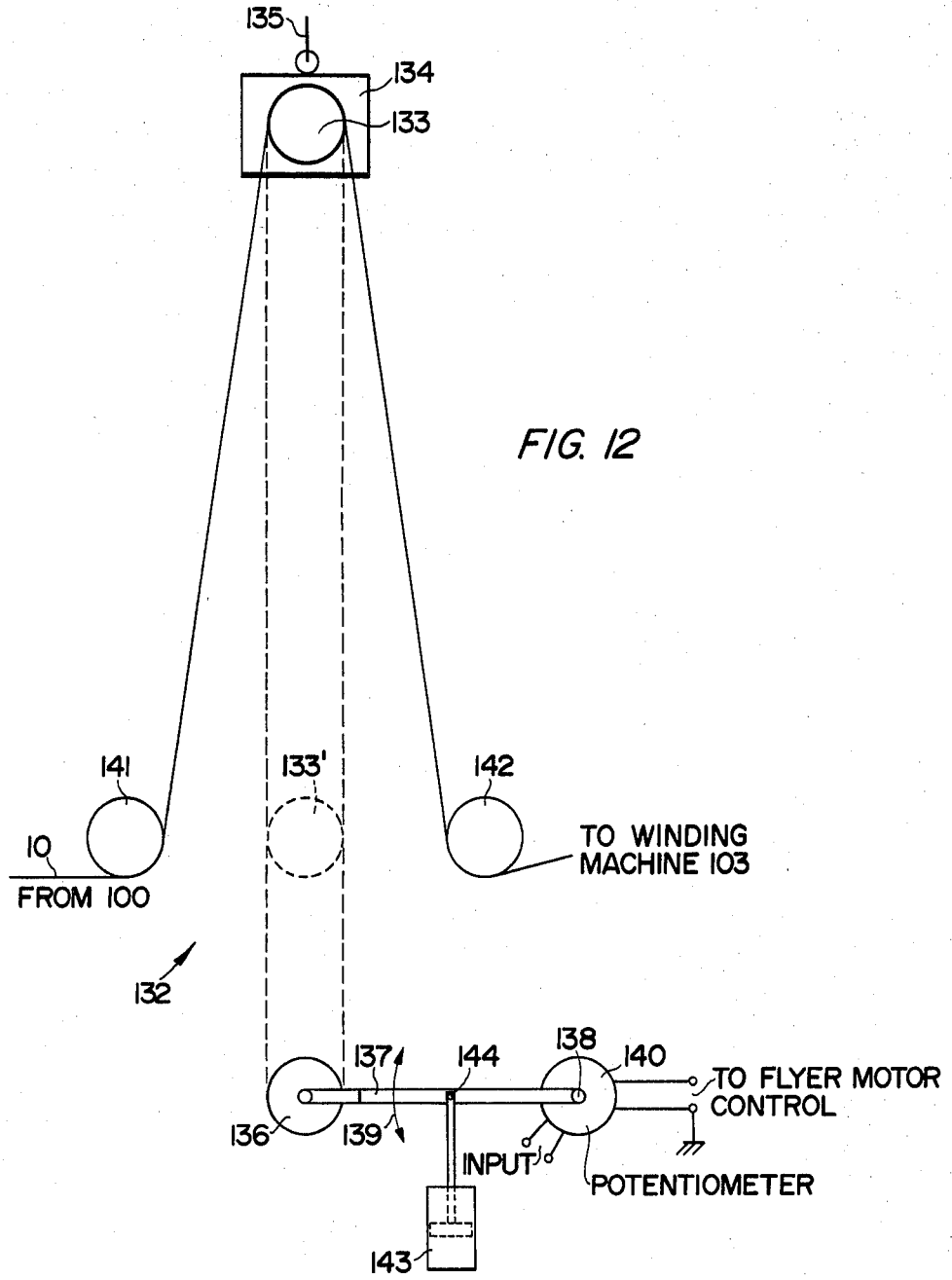
FIG. 12 is a simplified schematic illustration of an embodiment in which a block and tackle wire magazine is combined with the movable pulley means of a dancer for adjusting a motor speed control potentiometer.

FIG. 12 shows schematically a further embodiment of a block and tackle magazine 132 having a first movable set of pulleys 133 supported by a carriage 134 which is movable up and down by a cable 135 as described above with reference to FIG. 10. The first set of pulleys 133 may take up the upper full line position or the lower dashed line position 133'. The movable set of pulleys 133 cooperates with a second movable set of pulleys 136 carried at the free end of a lever arm 137 which is movable back and forth about a journal point 138 as indicated by the arrow 139. Thus, both sets of pulleys 133 and 136 are movable and the second set of pulleys 136 forms simultaneously part of a variable capacity magazine including the pulleys 133 and part of a dancer type sensor including the lever arm 137. The journal or pivoted end of the lever 137 adjusts a potentiometer 140 for controlling the speed of the flyer drive motor 105. Guide rollers 141 and 142 are operatively arranged at the input and output respectively of the block and tackle storage magazine 132. The operation of this embodiment will be described below.

Referring to FIGS. 9, 10, and 11, the movable set of pulleys 122 is normally in its lowermost position with the piston rod 113 fully extended. During this normal winding operation the entire system operates with a normal production speed. If it now becomes necessary to exchange a full drum for an empty drum, the wire take-up speed downstream of the dancer 102 may be reduced to a value, for example, between 0 and 1.5 m/s. Stated differently, the drum exchange may take place either with the flyer 104 stopped altogether or it may be exchanged at a relatively low wire take-up speed as soon as the exchange speed is reached, the flyer 104 is moved into the exchange position as described above, for example, with reference to FIG. 3 in which the flyer may be stopped. At this point no further wire is wound onto a drum. However, the wire continues to be supplied from the wire drawing machine 100 and this wire is now stored in the magazine 101 by moving the piston rod 113 downwardly to thereby increase the spacing "a" and thus the storage capacity of the magazine 101. As soon as the full drum has been replaced by an empty drum, the flyer is operated again and the flyer speed is increased to the normal production speed during this phase of the operation. Simultaneously with increasing flyer speed the piston cylinder arrangement 111 is operated to move the piston rod 113 upwardly to thereby reduce the magazine capacity. Any excess wire becoming available due to reducing the magazine storage capacity is taken up by a more rapid rotation of the flyer and the respective speed is controlled by the potentiometer 106 in response to the movement of the lever 107 which in turn depends in its movement on the up and down movement of the dancer pulleys 128.

By connecting according to the invention the larger capacity magazine 101 in series with the smaller capacity dancer magazine 102, the latter is able to very flexibly respond to the instantaneous operating condition of the apparatus to thereby compensate for the reduced speed of the flyer 104 and even for short standstill durations of the flyer. At the same time the sensitive response characteristic of the dancer magazine 102 compensates for the diameter differences as the winding of the drum progresses from an empty drum to a full drum to maintain a constant wire tension.

In FIG. 12 the dancer feature is integrated into the large capacity storage magazine 132. During the drum exchange the movable set of pulleys 133 moves into the upper full line position in FIG. 12, whereby the maximum magazine capacity is realized. During the normal winding operation when a drum is being filled, the movable set of rollers takes up the lower, dashed line position 133'. The roller set 136 with its pivoting arm 137 constitutes the so-called dancer and a normal wire tension may be adjusted by a sensitive piston cylinder arrangement 143, the piston rod of which is pivoted to the lever 137 at 144.

In operation, the dancer in FIG. 12 provides control signals to the flyer motor 105 depending on the instantaneous position of the lever arm 137. When the lever arm 137 is in the shown central, substantially horizontal position, the flyer speed is kept constant. If the wire tension increases, for example, due to the increasing of the drum diameter as it is being filled, the pivot arm 137 will move upwardly as indicated by the upper end of the double arrow 139, whereby the potentiometer 140 is adjusted to reduce the flyer r.p.m. and hence the winding speed. On the other hand, when the wire tension becomes smaller than is determined by the normal wire tension signified by the horizontal position of the lever arm 137, the latter moves downwardly as indicated by the lower end of the arrow 139, whereby the potentiometer adjusts the speed of the flyer motor 105 to increase the winding speed and thus to increase the wire tension back to its normal value which is maintained when the lever 137 is horizontal.

Although the invention has been described with reference to specific example embodiments, it will be appreciated, that it is intended, to cover all modifications and equivalents within the scope of the appended claims.

What is claimed is:

1. An apparatus for continuously winding elongated material onto winding carrier means, comprising support means for exchangeably supporting said winding carrier means, winding means including flyer means and drive means (105) for said flyer means operatively supported by said support means, first magazine means (101) comprising block and tackle means (101) having a variable storing capacity and being operatively arranged upstream of said winding means as viewed in the travel direction of said elongated material for storing said elongated material at least during a time when a full winding carrier means is being exchanged for an empty winding carrier means, while said elongated material is continuously moving in said travel direction toward said winding means, second magazine means (102) comprising elongated material storing means of the dancer type (102, 132) operatively arranged downstream of said first magazine means and between said first magazine means (101) and said winding means, said first and second magazine means being arranged in series, said second dancer type magazine means (102) comprising movably supported pulley means (128) for sensing the instantaneous tension of the elongated material running from said first magazine means over said movable pulley means (128) of said dancer type magazine means (102), and speed control means (106) operatively connected to said movable pulley means of said dancer type second magazine means (102) for positively varying the speed of said flyer drive means (105), said dancer type second magazine means (102) having a smaller storage capacity than said first magazine means so that the dancer type second magazine means flexibly respond to the instantaneous operating condition of the apparatus to keep the tension of said elongated material substantially constant during an exchange of a winding carrier means and during a winding operation, and wherein said variable storage capacity of said first magazine means is not limited by the second magazine means.

2. The apparatus of claim 1, wherein said block and tackle first magazine means comprise a stationary set of pulleys and a movable set of pulleys, piston cylinder means and cable pull means operatively connecting said piston cylinder means to said movable set of pulleys for varying the storage capacity of said block and tackle first magazine means.

3. The apparatus of claim 1, wherein said dancer type second magazine means comprise first stationary pulley means (124), second stationary pulley means (125) arranged below said first stationary pulley means for receiving elongated material from said first pulley means, movable pulley means (128), pivoting lever means (107) having a journal axis intermediate its ends, said movable pulley means being secured to one end of said pivoting lever means, said speed control means being operatively connected to said journal axis of said pivoting lever means, and tension adjustment means adjustably connected to the other end of said pivoting lever means for adjusting the tension of elongated material to a normal winding value, said speed control means being responsive to deviations from said normal value for returning said tension to said normal value.

4. An apparatus for continuously winding elongated material onto winding carrier means, comprising support means for exchangeably supporting said winding carrier means, winding means including flyer means (104) and drive means (105) for said flyer means operatively supported by said support means, magazine means having a variable storage capacity, said magazine means being operatively arranged upstream of said winding means as viewed in the travel direction of said elongated material for storing said elongated material at least during a time when a full winding carrier means is being exchanged for an empty winding carrier means, while said elongated material is continuously moving in said travel direction toward said winding means, dancer type sensor means (136) integrated into said magazine means, said magazine means comprising first movable pulley means (133), carriage means (134) for movably supporting said first pulley means, and second movable pulley means (136) operatively arranged to form simultaneously part of said dancer type sensor means and part of said magazine means, said dancer type sensor means comprising speed control means (140) including pivot lever means (137) for movably supporting said second movable pulley means (136), said speed control means (140) being operatively connected to said pivot lever means (137) carrying said second movable pulley means (136) for adjusting said speed control means (140), said apparatus further comprising means (143) for maintaining a normal predetermined feed advance speed during normal operating conditions, said normal feed advance speed maintaining means (143) being operatively connected to said pivot lever means for normally maintaining said pivot lever means in a central position whereby said dancer type sensor means flexibly respond to the instantaneous position of said second pulley means (136) and thus indirectly to the instantaneous filling status of said magazine means, to keep the tension of said elongated material substantially constant during an exchange of a winding carrier means and during a winding operation, and whereby the variable storage capacity of the magazine means is not limited by the adjustment of speed control means.

* * * * *